US009499337B2

(12) United States Patent
Fitzgerald et al.

(10) Patent No.: US 9,499,337 B2
(45) Date of Patent: Nov. 22, 2016

(54) RECEPTACLE CONFIGURED FOR LINER REPLACEMENT WITHOUT LID REMOVAL

(71) Applicant: T. M. Fitzgerald & Associate, Havertown, PA (US)

(72) Inventors: Thomas M Fitzgerald, Havertown, PA (US); David D McClanahan, Harleysville, PA (US)

(73) Assignee: T.M. Fitzgerald & Associates, Havertown, PA (US)

( * ) Notice: Subject to any disclaimer, the term of this patent is extended or adjusted under 35 U.S.C. 154(b) by 0 days.

(21) Appl. No.: 14/834,845

(22) Filed: Aug. 25, 2015

(65) Prior Publication Data

US 2016/0052711 A1 Feb. 25, 2016

Related U.S. Application Data

(60) Provisional application No. 62/041,193, filed on Aug. 25, 2014.

(51) Int. Cl.
*B65F 1/06* (2006.01)
*B65F 1/14* (2006.01)

(52) U.S. Cl.
CPC ..... *B65F 1/06* (2013.01); *B65F 1/1615* (2013.01); *B65F 1/1646* (2013.01)

(58) Field of Classification Search
CPC ..... B65F 1/06; B65F 1/1646
USPC ..... 220/495.01, 495.06, 495.08, 495.11, 220/908, 657, 656, 260, 262, 263, 810, 836, 220/837, 845
See application file for complete search history.

(56) References Cited

U.S. PATENT DOCUMENTS

| | | | | | |
|---|---|---|---|---|---|
| 3,314,632 | A * | 4/1967 | Freuler | B65F 1/06 | 232/43.2 |
| 3,760,975 | A * | 9/1973 | Nilsson | B65F 1/06 | 206/216 |
| 3,888,406 | A | 6/1975 | Nippes | | |
| D250,744 | S * | 1/1979 | Morin | D34/5 | |
| 4,753,367 | A | 6/1988 | Miller et al. | | |
| 4,765,579 | A * | 8/1988 | Robbins, III | B65F 1/06 | 220/495.04 |
| 4,953,740 | A * | 9/1990 | Koda | B65F 1/06 | 220/263 |
| 4,972,966 | A * | 11/1990 | Craft, Jr. | B65F 1/06 | 220/263 |
| 5,628,424 | A | 5/1997 | Gola | | |
| 6,728,996 | B2 | 5/2004 | Roscow | | |
| 8,066,144 | B2 | 11/2011 | McNamara et al. | | |
| 8,292,114 | B1 | 10/2012 | Tabele, Jr. | | |
| 8,448,805 | B2 | 5/2013 | Hassell et al. | | |
| 8,720,728 | B2 | 5/2014 | Yang et al. | | |
| 2004/0074907 | A1 | 4/2004 | Gardner | | |

(Continued)

*Primary Examiner* — Robert J Hicks
*Assistant Examiner* — Kareen Thomas
(74) *Attorney, Agent, or Firm* — Invention To Patent Services; Alex R Hobson

(57) ABSTRACT

A receptacle having a lid coupled to a receptacle body by a hinge is configured for the replacement of a flexible liner without removal of the lid. A flange extension is configured at an offset distance to the hinge and enables the perimeter of the flexible liner to be retained in a liner retainer and extend up and over the hinge and into a flange extension on the opposing side of the hinge. This configuration holds the perimeter of the flexible liner taut and ensures that it remains in place as contents are placed in the receptacle. A pair of trunnion hinges may extend in opposing directions from the receptacle body to provide a detachable attachment of a lid. A flange extension may extend substantially around the liner retainer portion or only a certain distance from the end of a hinge.

17 Claims, 8 Drawing Sheets

(56) References Cited

U.S. PATENT DOCUMENTS

| | | | | |
|---|---|---|---|---|
| 2008/0179330 | A1* | 7/2008 | Brooks | B65F 1/06 220/495.08 |
| 2008/0272127 | A1 | 11/2008 | Kovacevich et al. | |
| 2009/0039081 | A1 | 2/2009 | Fort et al. | |
| 2010/0147865 | A1 | 6/2010 | Yang et al. | |
| 2012/0118895 | A1 | 5/2012 | Lin | |
| 2012/0217247 | A1 | 8/2012 | Adkins et al. | |
| 2013/0233857 | A1 | 9/2013 | Yang et al. | |
| 2013/0277370 | A1 | 10/2013 | Paculdo | |

* cited by examiner

RECEPTACLE CONFIGURED FOR LINER REPLACEMENT WITHOUT LID REMOVAL

CROSS-REFERENCE TO RELATED APPLICATIONS

This application claims the benefit of and priority to U.S. provisional patent application No. 62/041,193, filed on Aug. 25, 2014 and entitled Receptacle Configured For Liner Replacement Without Lid Removal; the entirety of which is incorporated by reference herein.

BACKGROUND OF THE INVENTION

Field of the Invention

The present invention relates to a receptacle that is configured for replacement of a flexible liner without removal of the lid.

Background

Receptacles, and particularly trash receptacles, require frequent change out of flexible liners. In most cases the receptacle lid, retainer collar, or receptacle insert have to be removed to allow change out of the flexible liner. In facilities having a large number of trash receptacles, this process can be time consuming. Flexible liners are retained in a receptacle by a flange that extends around the opening of the receptacle. Flexible liners are sized such that the opening perimeter of the flexible liner is held taut around the perimeter of the receptacle as it is pulled over the flange. This configuration is effective for open top receptacles, however the addition of a hinged lid coupled with the receptacle body interrupts the opening perimeter of the receptacle, wherein the flexible liner cannot be retained by the flange. Therefore, many hinged lid receptacles are configured with a separate retainer collar that fits over the opening of the receptacle to retain the bag, or a separate insert that is configured to fit within the receptacle and retain the flexible liner. In another attempt to accommodate a flexible liner with a hinged lid receptacle, the liner is slit to extend around the lid hinges, as described in U.S. Pat. No. 8,534,488 to Naum, et al.

There exists a need for a receptacle having a hinged lid that will allow change out of a flexible liner without removal of the lid.

SUMMARY OF THE INVENTION

The invention is directed to a receptacle that is configured for replacement of a flexible liner without removal of the lid. A receptacle may be any suitable type of receptacle and in an exemplary embodiment is a trash or refuse receptacle. The receptacle, as described herein, comprises a lid, and in an exemplary embodiment, the lid is readily detachably attachable. A lid is coupled to the receptacle body by a hinge. Any suitable type and configuration of hinge may be employed to retain the lid to the receptacle body. In an exemplary embodiment, the receptacle body comprises trunnions and the lid comprises a recess of aperture for attachment to the trunnions. A trunnion may comprise a post, such as a cylindrically shaped post, and a head that is larger in diameter for retention of the lid on the post. An exemplary receptacle comprises a flexible liner retention portion that comprises a flange that extends substantially around the opening perimeter of the receptacle body. In an exemplary embodiment, the liner retention portion comprises a flange extension that is integrally attached to the receptacle body, such as being molded as a one-piece unit. A liner retention portion comprises a flange that, in an exemplary embodiment, extends out from the receptacle body and down to form a channel for retaining the outer opening of a flexible liner. A liner retention portion comprises a flange extension that extends from the flange, and in an exemplary embodiment, extends down a substantial distance, such as more than about 5 mm from the flange. A flange and/or a flange extension may be configured at an offset distance from a hinge. The flange extension allows a flexible liner perimeter to extend above, or up and over, a hinge and still be effectively retained. A flexible liner configured above a hinge can be replaced without removal of the lid. This saves time and money, especially in locations where a large number of flexible liners have to be changed out, such as hotels or hospitals, for example.

An exemplary receptacle has walls that extend up from a base to an opening for receiving a flexible liner within the interior. A receptacle may be any suitable size and have any suitable interior volume including, but not limited to, more than about 1 liter, more than about 3 liters, more than about 10 liters, more than about 20 liters, more than about 50 liters, more than about 100 liters and any range between and including the interior volumes provided. A receptacle may have any suitable height including, but not limited to, greater than about 20 cm, greater than about 50 cm, greater than about 70 cm, greater than about 1 m and any range between and including the receptacle height values provided. A receptacle may have any suitable perimeter shape including round, rectangular, square and the like. In an exemplary embodiment, a receptacle has a substantially rectangular shape as shown in FIG. 1A-1C and comprises a left side, a right side, a front-side and back-side, as well as a base at the bottom and receptacle opening at the top of the receptacle. The receptacle including the receptacle body and lid have an exterior surface and an interior surface. The interior surface forms the enclosed space when the lid is in a down and closed position, as shown in FIG. 1B.

An exemplary receptacle, including the lid and/or receptacle body, may be made out of any suitable material including, but not limited to, rubber, plastic, metal, composite materials, ceramic, and the like. In an exemplary embodiment, a receptacle is made out of plastic and is molded and may consist of two pieces, a receptacle body and a receptacle lid. The receptacle body may be a one-piece unit comprising the hinge or trunnions and the flexible liner retainer portion. A receptacle may also comprise a latch configured to retain the lid in a closed position. A hook may be coupled to the lid and engage with the liner retainer portion or distinct latch, for example.

An exemplary receptacle comprises a hinge that couples the lid to the receptacle body. A lid may be fixed to the receptacle body or may be detachably attachable to the receptacle body by the hinge. A hinge may be configured as an integral part of the receptacle body whereby the hinge and lid are molded as a one-piece unit, for example. A hinge may be configured in any suitable location on the receptacle body and in an exemplary embodiment is configured on the outside and proximal to the perimeter opening of the receptacle body. A hinge may be configured along the back-side of the receptacle body and comprises a standard post and collar type hinge. In an exemplary embodiment, a pair of trunnions are configured for attaching a lid to the receptacle body. A lid may comprise coupling recesses or apertures that are configured to mount to the trunnions, or posts of the trunnions. In one embodiment, the trunnions comprise a post and a head and the lid comprises a recess for coupling to the posts. A lid coupling recess may be circular in shape and may have a recess opening that has a smaller dimension than the post dimension, thereby requiring deflection of the lid coupling recess to engage the recess to the post. The posts of the trunnions are preferably cylindrical having a circular cross-sectional shape. The trunnions may extend outward from the receptacle body and may extend beyond the flexible liner retainer portion. Trunnions may be configured on opposing sides of the receptacle body, such as a left and an opposing right side. Trunnions may be configured to extend in opposing directions and be coupled to a round or circular shaped receptacle body. Trunnions, or a trunnion body may be coupled with or extend from the receptacle perimeter or liner retaining portion to provide additional stability.

The flexible liner retainer portion comprises a flange that, in an exemplary embodiment, extends out from the outside surface of the receptacle body and then down to form a channel for retaining a flexible liner. As described, a liner retainer portion may be integral with the receptacle body, wherein the receptacle body and liner retainer portion are a one-piece unit, such as being molded in a single mold. The depth of the channel, flange and/or flange extension may be a depth or length including, but not limited to, greater than about 0.75 cm, greater than about 1 cm, greater than about 2 cm, greater than about 4 cm and any range between and including the dimensions provided. A flange extension may be at least three quarters the length of the flange to provide a suitable extension from the flange for retaining the liner and preventing the liner from pulling out of the flange, especially around the hinge. A flange extension may be configured substantially along the entire flange and preferable is configured starting at an offset distance from a hinge and extending some distance away from a hinge to secure the liner in position over the hinge. The offset distance may be greater than about 1 cm, 2 cm, 4 cm, 6 cm, 8 cm, and any range therebetween, and is preferably not too large as this may compromise the retention of the liner in position within the channel. In one embodiment, a hinge is configured along the back-side of the receptacle body and the flange extensions extend along the sides and front-side of the receptacle body. In another embodiment, a hinge comprises two trunnions that extend in opposing directions, such as from the left and right side of the receptacle body, and the flange extension is configured along the back side between the two trunnions, and starting at an offset distance extend along the sides and front of the receptacle body.

A flexible liner may be a conventional trash back and may comprise a drawstring that extends around the liner perimeter, or liner opening perimeter. A flexible liner may be sized such that the liner perimeter is taut when configured around the flexible liner retainer portion, or over the opening perimeter.

A method of replacing a receptacle liner without removing the lid is provided for by any of the embodiments of the present invention. The method comprises the steps of first opening the lid and removing the liner from receptacle. The liner may be pulled out from the channel defined by the flange and flange extension and removed from the receptacle body. A new liner may then be inserted into the interior volume of the receptacle with the closed end being pushed down into the receptacle and the liner perimeter being extended around the receptacle body perimeter. The liner perimeter may then be pulled down over the flange and flange extension(s) and inserted into the channel. The lid may then be closed to complete the replacement of the liner.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1A:
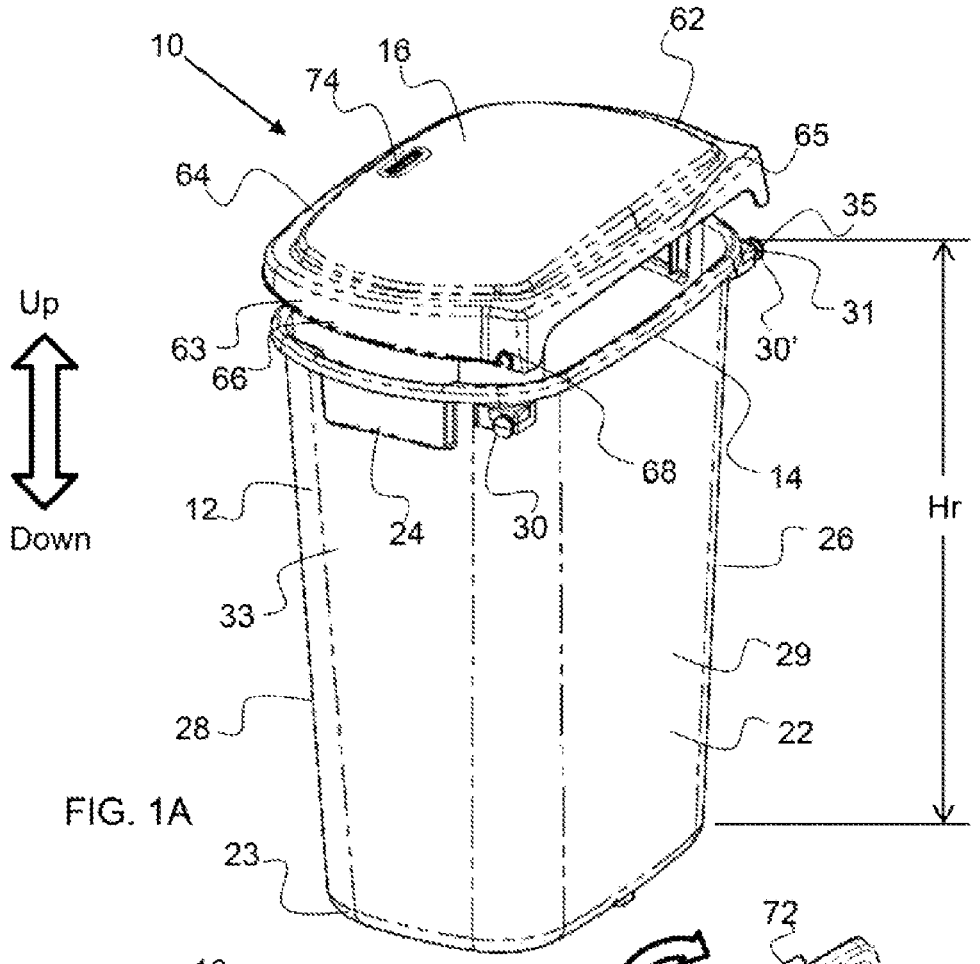

FIG. 1A shows an isometric view of a receptacle having a lid and a receptacle body with trunnions for attachment of the lid.

Figure 1B:
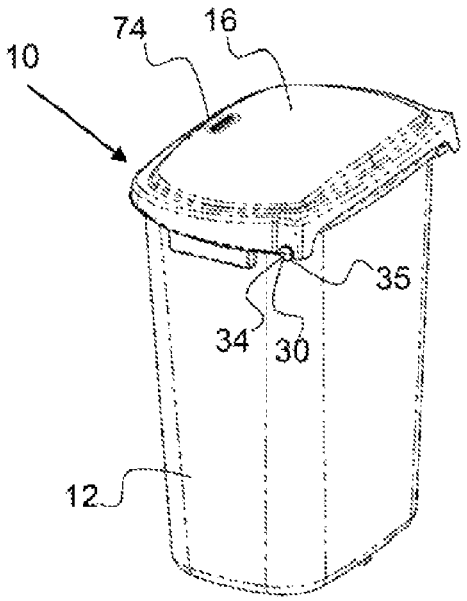

FIG. 1B shows an isometric view of the receptacle in FIG. 1A with the lid attached and in a closed position.

Figure 1C:
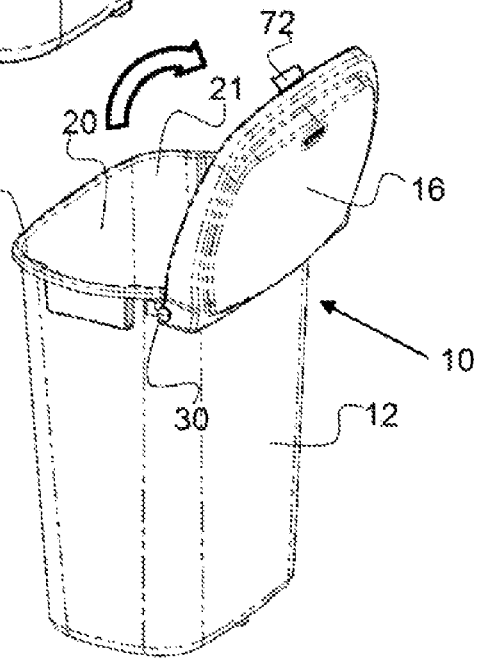

FIG. 1C shows an isometric view of the receptacle in FIG. 1A with the lid attached and in a open position.

Figure 2:
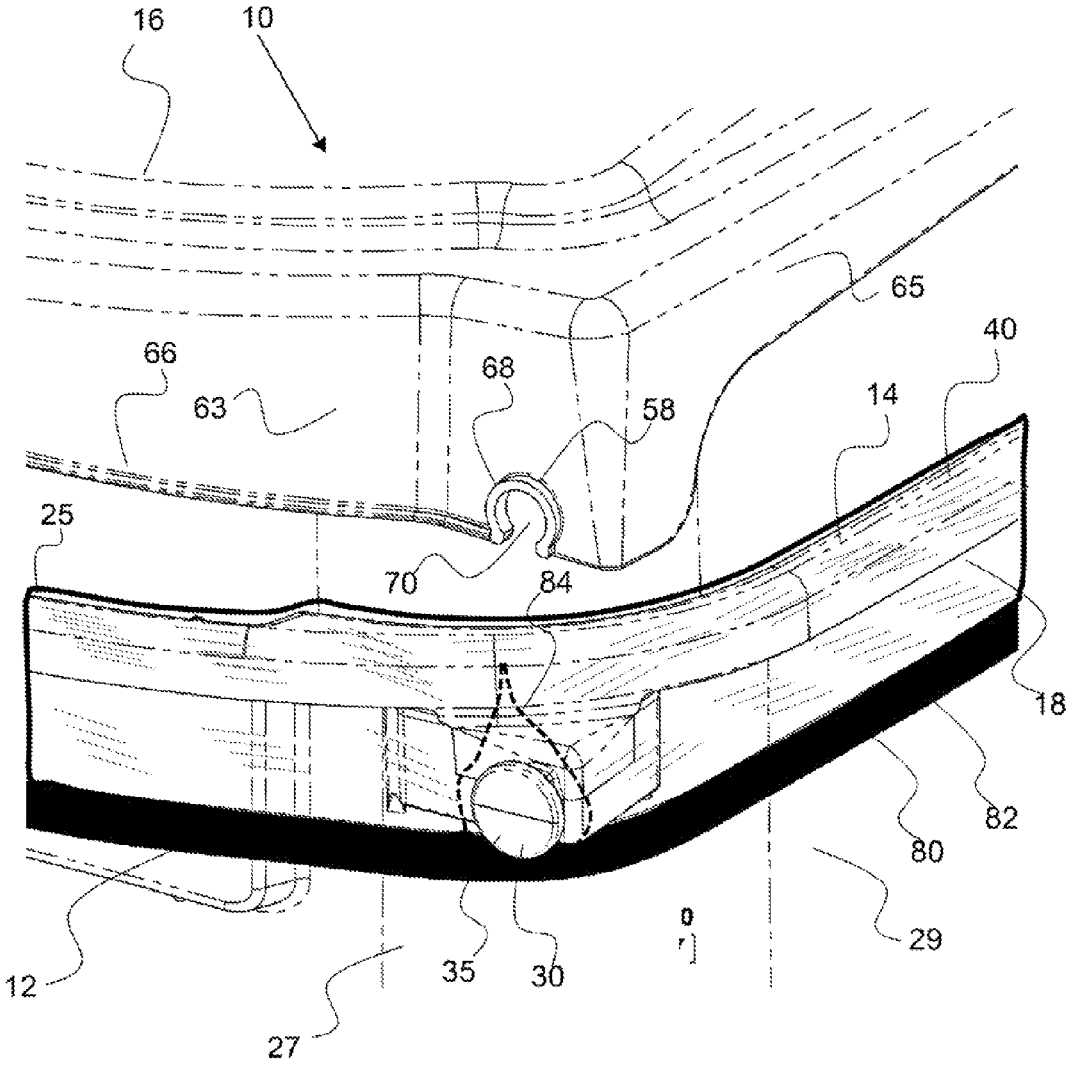

FIG. 2 shows an isometric view of a receptacle having a flexible liner retained by the receptacle body and extending down over a trunnion wherein the flexible liner is torn by attachment of the lid.

Figure 3:
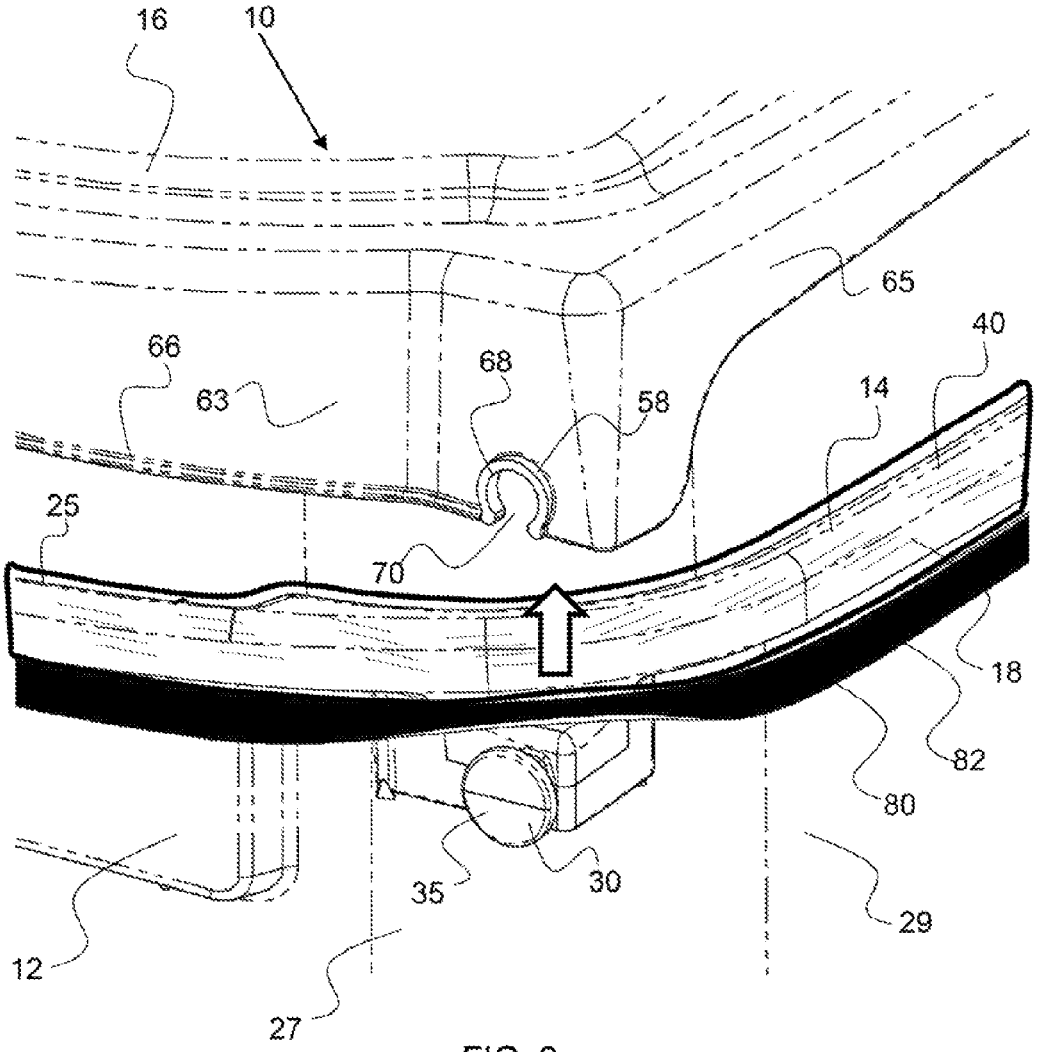

FIG. 3 shows an isometric view of a receptacle having a flexible liner retained by the receptacle body and extending up and over a trunnion wherein the flexible liner is not securely retained therein.

Figure 4:
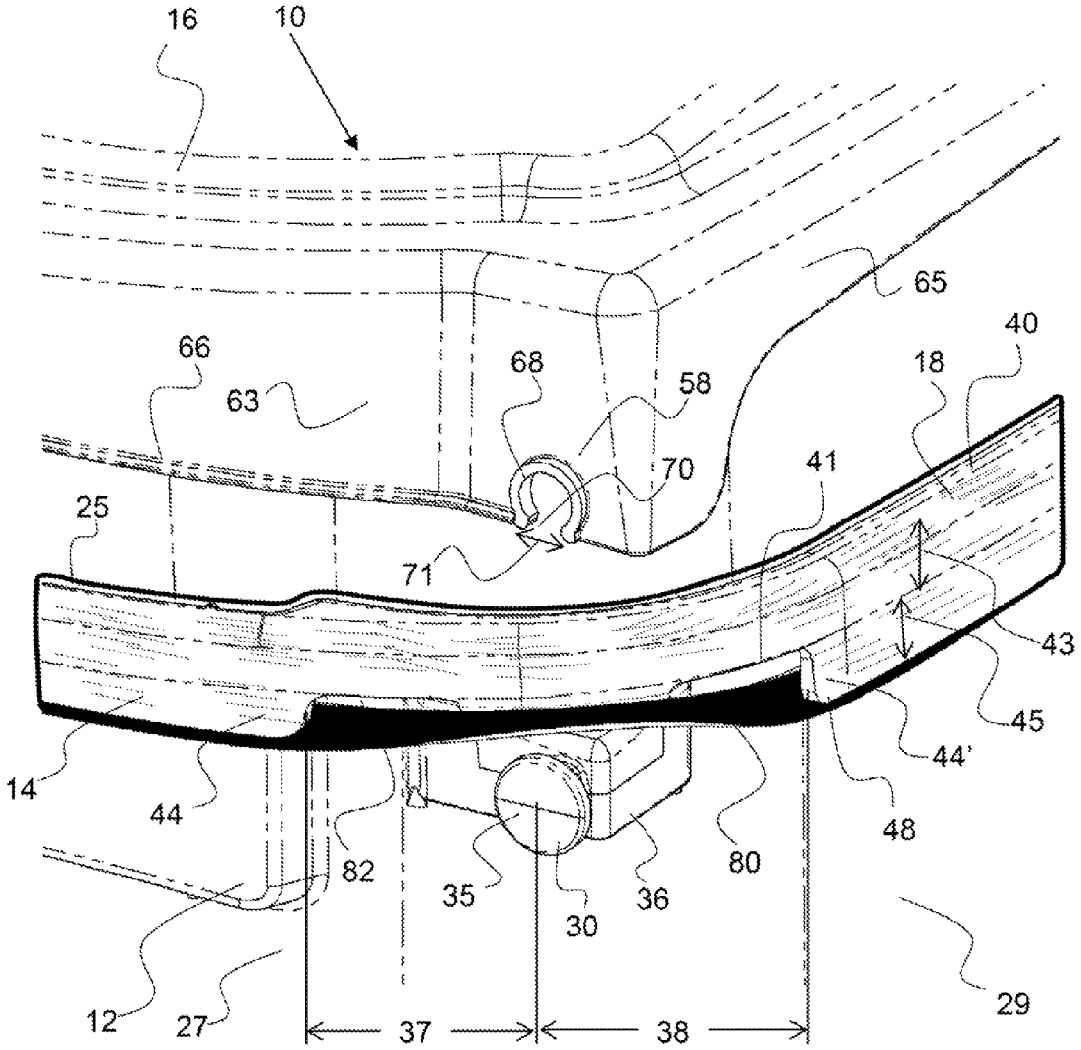

FIG. 4 shows an isometric view of an exemplary receptacle of the present invention having a flexible liner retained by the receptacle body in a liner retainer portion, extending up and over a trunnion and into flange extensions, wherein the flexible liner is securely retained.

Figure 5:
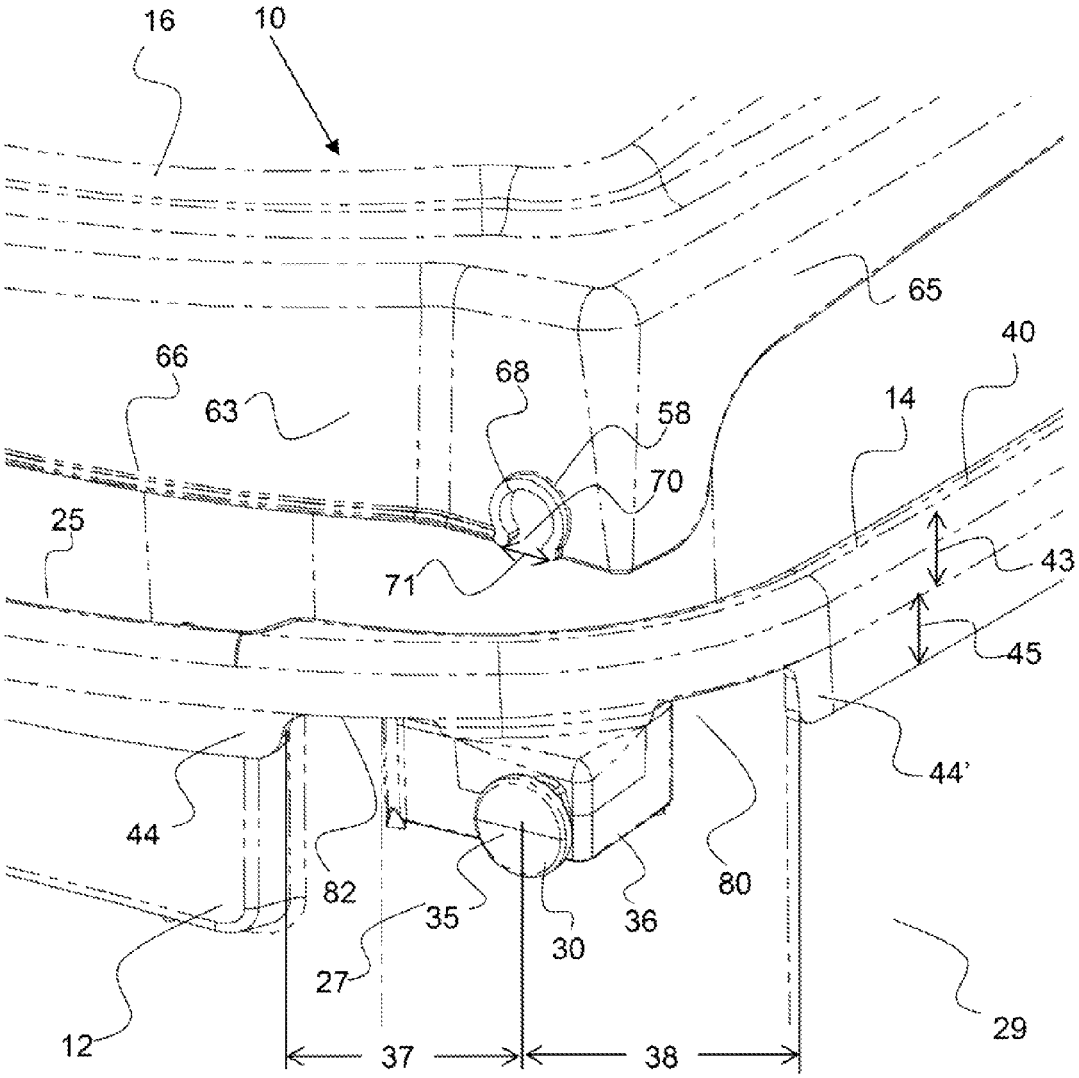

FIG. 5 shows an isometric view of an exemplary receptacle of the present invention having a pair of flange extensions configured at an offset distance from the trunnion body.

Figure 6A:
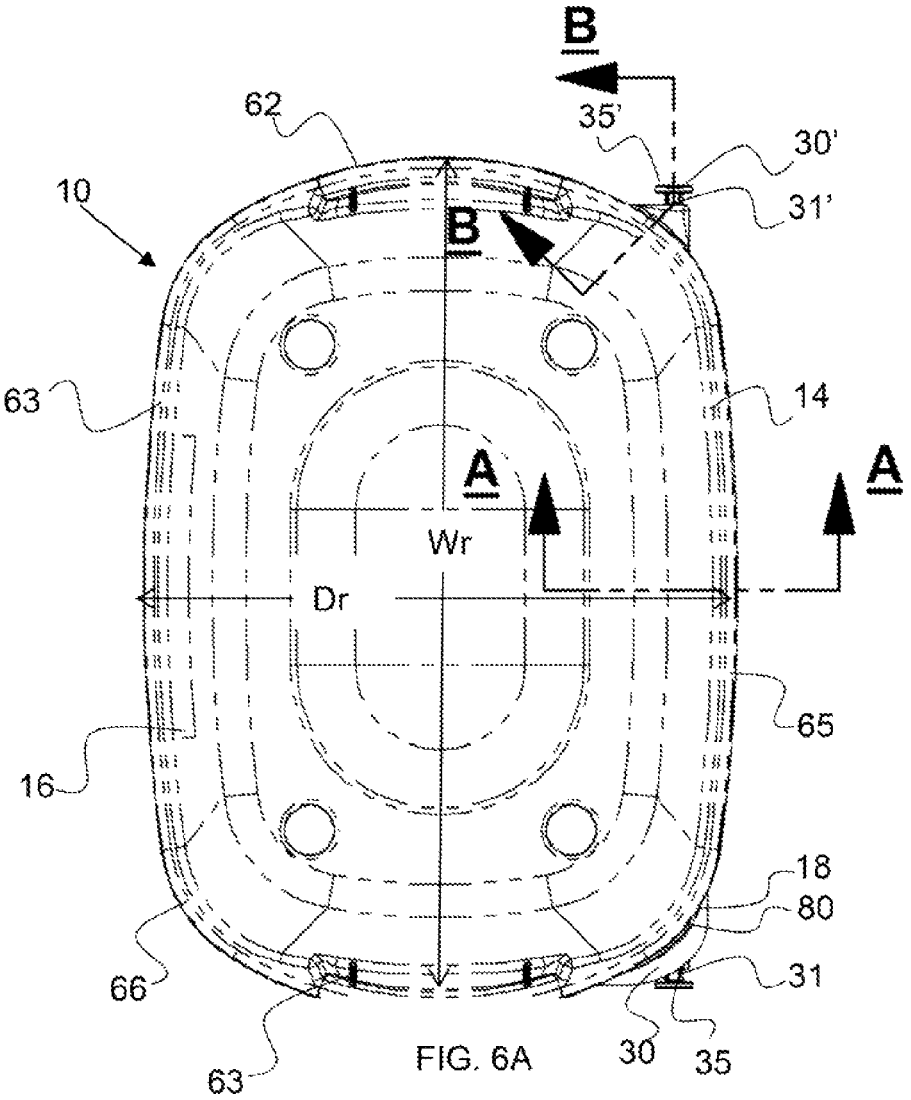

FIG. 6A shows a top down view of an exemplary receptacle having trunnions extending outward beyond the flexible liner retainer portion.

Figure 6B:
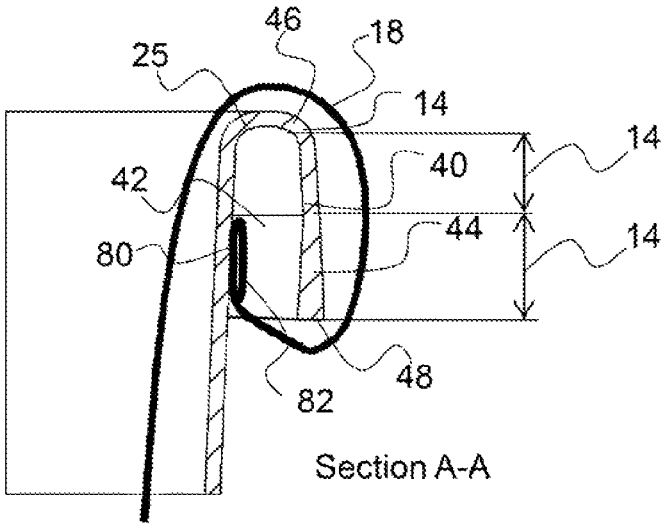

FIG. 6B shows a cross-section view along line A-A of FIG. 6A of the flexible liner retainer portion.

Figure 6C:
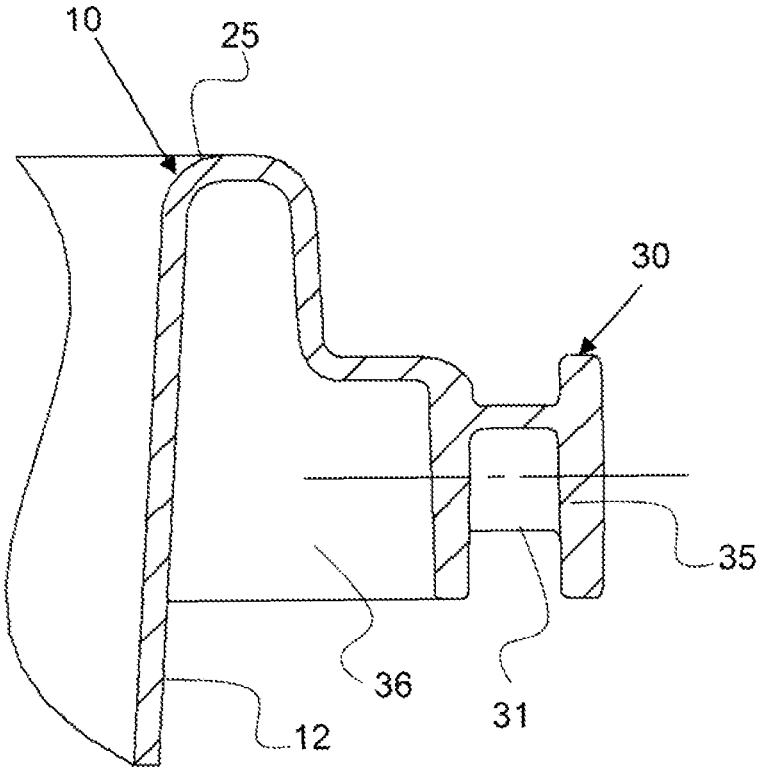

FIG. 6C shows cross-section view along line B-B of FIG. 6A of the trunnion.

Figure 7A:
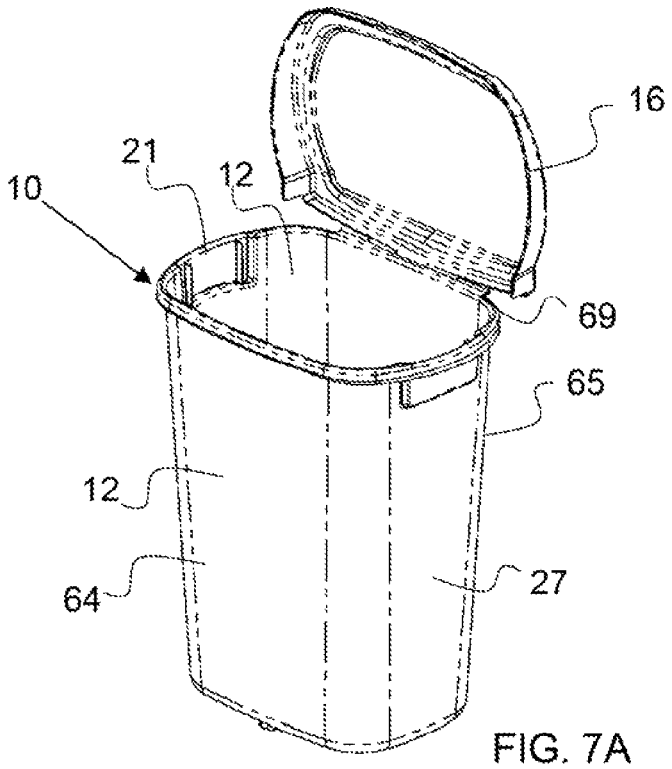

FIG. 7A shows an isometric view of a receptacle having a lid and a receptacle body with a back-side hinged lid.

Figure 7B:
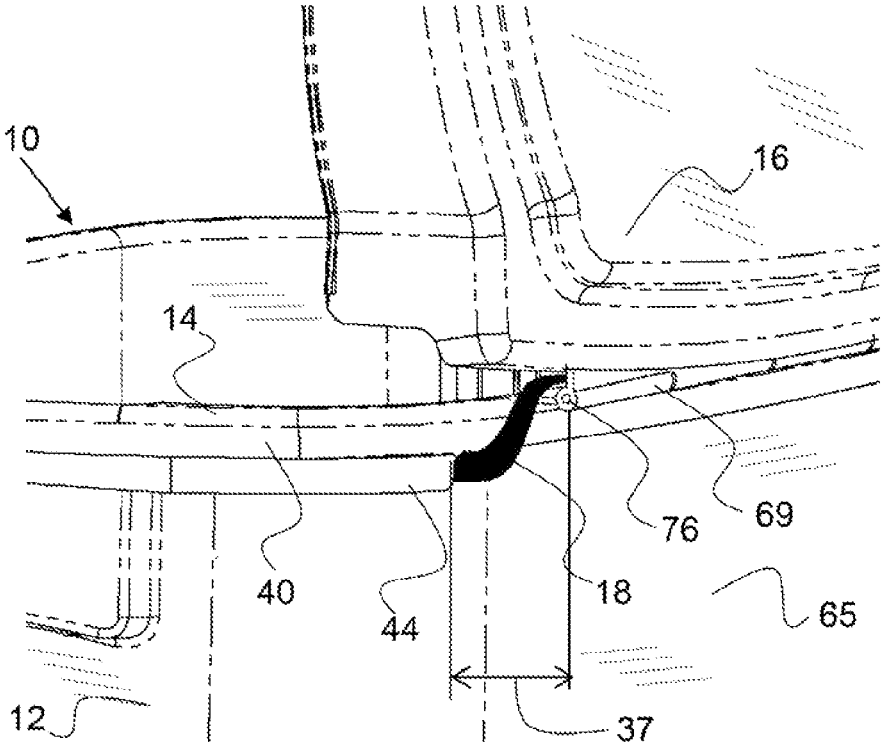

FIG. 7B shows an enlarged isometric view of a portion of FIG. 7A, showing the hinged lid on the back-side.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown if FIGS. 1A-1C, a receptacle 10 has a lid 16 and a receptacle body 12 with trunnions 30, 30' for attachment of the lid. The lid comprises a plurality of hinge couplers 58 comprising recesses 68, as shown in FIG. 2, for detachably attaching the lid to the receptacle body. The hinge couplers 58 attach to the trunnions 30, 30' on either side of the receptacle to form a hinge. The trunnions comprise a post 31 and a head 35 for receiving the lid recess. The receptacle body comprises a front-side 28, a back-side 29, a right-side, 33, a left-side 26, a plurality of handles 24 configured on the left-side and right-side, a base 23, an interior 20, an opening 21 and an opening perimeter 25. The receptacle body comprises a bag retainer portion 14 that extends around the opening perimeter 25 and is configured to retain a flexible liner perimeter. A flexible liner, such as a bag, may be sized such that the liner perimeter is taut when pulled around the opening perimeter and retained by the liner retainer portion. A receptacle lid may comprise a latch 72, as shown in FIG. 1C, that is configured to couple with the receptacle body to retain the lid in a down and closed position, as shown in FIG. 1B. A lid may further comprise a latch release 74 that can be pushed, for example, to actuate the latch and release it. As shown in FIG. 1C the lid 16 has pivoted open, as indicted by the bold arced arrow. The lid has pivoted about the trunnions configured on opposing sides of the receptacle body. A receptacle may comprise a foot pedal actuated lid, wherein pressing of the foot pedal actuates the lid to open.

The height Hr of the receptacle body 12 is shown in FIG. 1A. In addition, arrows to indicate up and down directions are provided next to FIG. 1A.

As shown in FIG. 2, a receptacle 10 has a flexible liner 18, depicted by the bold line and cross-hashed shading, retained by the receptacle body 12. The flexible liner is extending down over a trunnion 30, wherein the flexible liner is tom by attachment of the lid 16, as indicated by the dashed bold line around the head 35 of the trunnion. The liner perimeter 80, or in some cases a drawstring 82, is pulled down over the trunnion. In this configuration, the flexible liner will develop a tear 84 as the hinge coupler 58 is attached to the trunnion 30 to form a hinge. A tear in the liner is not desirable as it can propagate and result in spilling of contents retained within the liner.

As shown in FIG. 3, a receptacle 10 has a flexible liner 18, depicted by the bold line and cross-hashed shading, retained by the receptacle body and extending above a trunnion. The flexible liner is not securely retained, as it can be pulled into interior of the retainer body as indicated by the large bold arrow. In this configuration, the flexible liner is retained in a liner retainer portion 14 but extends up above or on top of the trunnion and is not retained in this area, or in the corner of the receptacle body. As contents are placed in the receptacle and tension is created on the liner, the liner perimeter will pull up and over the opening perimeter 25, as indicated by the large arrow. As soon as one portion of the liner has been pulled into the receptacle interior, the tension of the liner perimeter 80 will no longer effectively hold the flexible liner in place and it will fall into the receptacle as additional contents are placed therein. This is not desirable.

As shown in FIG. 4, an exemplary receptacle 10 of the present invention has a flexible liner 18 retained in the liner retainer portion 14 of the receptacle body 12 and extending up above a trunnion 30 and into flange extensions 44, 44', wherein the flexible liner is securely retained. In this exemplary embodiment, the liner retainer portion comprises flange extensions that extend down from the flange 40 and have an offset distance 37, 38 from the post head 35. The flange extension 44 has an offset distance 37 and extends along the right side 27 of the receptacle body 12 and flange extension 44' has an offset distance 38 and extends along the back-side 29 of the receptacle body. The flange extensions extend all the way around the opening perimeter of the receptacle body except for the offset distances around the trunnions. It is to be understood that the flange extensions do not have to extend all the way around the opening perimeter, but may be configured at some offset distance from the hinge and then extend some distance away from the hinge. The liner retainer portion of the receptacle body extends all the way around the opening perimeter of the receptacle body except for where the trunnions are coupled therewith, and therefore extend substantially all the way around the opening perimeter. The flange extensions enable the liner to be securely retained within the liner retainer portion even though the liner perimeter extends above the trunnion. The flexible liner perimeter 80 is held taut over the trunnion 30 and extends under the flange extensions 44, 44'. The flange extensions have a length 45 that extends from the extended end 41 of the flange to the extended end of the flange extension 48. The flange has a length 43 which may be less than the flange extension length. The offset distance of the flange extensions enable the flexible liner to be removed, inserted or replaced without removal of the lid 16 from the trunnions 30. The flexible liner is configured above the trunnion and therefore can be pulled out of the receptacle with the lid securely attached to the trunnions. The lid 16 has a hinge coupler 58 comprising a coupling recess 68 configured to be coupled with the trunnion and specifically configured for attachment to the post of a trunnion. The coupling recess is configured in the perimeter 66 of the lid and has a circular shape with an opening 70 that has an opening distance 71 that may be smaller than a post diameter. This configuration may effectively retain the coupling recess to a post, as the recess opening may have to deform slightly to attach around a trunnion post to create a hinge.

As shown in FIG. 5, the receptacle shown in FIG. 4 has the flexible liner removed in order to more clearly show the trunnion and flange extension configurations.

With reference to FIGS. 6A-6C, an exemplary receptacle 10 has trunnions 30, 30' extending outward from the receptacle body 12 and beyond the flexible liner retainer portion 14, which is indicated by the dashed line within the lid perimeter 66. The trunnions comprise a post 31 and a head 35. The head is larger in cross-axis dimension, or diameter, to prevent the lid coupling recess from sliding off of the post. The flexible liner 18 is shown being configured over the top of the trunnion 30 with the liner perimeter extending above or over the trunnion post 31. As described, this configuration enables replacement of the flexible liner without removal of the lid. The receptacle has a rectangular shape having a width Wr and depth Dr as shown in FIG. 6A.

As shown in FIG. 6B, an exemplary liner retainer portion 14 comprises an integral flange 46 and flange extension 44 that produces a channel 42 for retention of a flexible liner 18. The flexible liner perimeter 80, or drawstring 82, are configured within the channel.

As shown in FIG. 6C, the exemplary trunnion 30 is integrally attached to the receptacle body 12, whereby they are molded as a one-piece unit. The trunnion body 36 extends from the receptacle body to the trunnion post 31. The trunnion head 35 is larger in cross-axis dimension, or diameter, than the trunnion post. The post axis is shown as the dashed line extending along the length of the post and out of the trunnion head.

As shown in FIG. 7A, an exemplary receptacle 10 comprises a receptacle body 12 and a lid 16 coupled to the receptacle body by a hinge 69 configured along the back-side of the receptacle.

As shown in FIG. 7B, a liner retainer 14 and flange extension 44 extend from around the outside and top perimeter of the receptacle body 12. The flexible liner 18 extends under the flange extension 44 and up over the hinge 69. The flange extension ensures retention of the flexible liner with the liner configured up and over the hinge. The flange extension 44 is configured at an offset distance 37 from the end of the hinge 76. This offset distance may be any suitable amount including, but not limited to, greater than about 5 mm, greater than about 10 mm, greater than about 20 mm, greater than about 35 mm, greater than about 50 mm and any distance between and including the offset distances provided.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A receptacle comprising:

a. a receptacle body comprising:

i. an interior for receiving a flexible liner;

ii. an exterior;

iii. an opening having an opening perimeter;

iv. a pair of trunnion hinges comprising a first trunnion and a second trunnion configured on and extending outward from said receptacle body exterior; wherein each trunnion comprises a trunnion post for detachably attaching a lid;

wherein the first trunnion extends outward from the receptacle body in a first direction and the second trunnion extends outward from said receptacle body in a second and opposing direction;

v. a liner retainer portion comprising;

1. a flange that extends substantially around said opening perimeter to form a channel for receiving and retaining a flexible liner perimeter therein;

2. a flange extension extending downward from said flange and having a flange extension length, wherein said flange extension is configured at an offset distance from said trunnion posts;

b. a lid detachably attached to said receptacle by a hinge coupler comprising a lid recess that extends at least partially around said post of the trunnion:

wherein the receptacle body is configured to received and retain a flexible liner with the flexible liner perimeter retained in said channel and extending from the flange extensions over said hinge;

whereby the flexible liner can be replaced with a new flexible liner without detaching the lid from said hinge.

2. The receptacle of claim 1, wherein the receptacle is a trash receptacle.

3. The receptacle of claim 1, wherein the liner retainer portion is an integral liner retainer portion with the receptacle body, wherein the receptacle body and liner retainer portion are a one-piece unit.

4. The receptacle of claim 1, wherein the flange extends out from the opening perimeter and down to an extended end to form the channel.

5. The receptacle of claim 1, wherein the first and second trunnions extend outward from said receptacle body beyond the liner retainer portion.

6. The receptacle of claim 1, wherein the first and second trunnions comprise said post and a head located at an extended end of said post;

wherein the head is larger in a cross-dimensional distance than said head;

whereby the lid is configured to be retained on the trunnion posts by the hinge coupler comprising said lid recess that is configured at least partially around said post.

7. The receptacle of claim 1, wherein the first trunnion extends outward from the receptacle body in a first direction and the second trunnion extends outward from said receptacle body in a second and opposing direction.

8. The receptacle of claim 1, wherein the first and second trunnions are integral trunnions with the receptacle body, wherein the receptacle body and trunnions are a one-piece unit.

9. The receptacle of claim 1, wherein the first trunnion is configured on a left side of the receptacle body and the second trunnion is configured on a right side of the receptacle body.

10. The receptacle of claim 9, wherein the lid comprises a left and a right side, a lid perimeter and a first and second hinge coupler, each comprising said lid recess configured in the lid perimeter on said left and opposing right side respectively and wherein the lid recesses are configured to couple with the trunnion posts to detachably attach the lid to the receptacle body.

11. The receptacle of claim 9, wherein the flange extends completely around the receptacle perimeter and wherein the flange extension is configured along a back-side of the receptacle body starting at a first offset distance from the trunnions and around the receptacle perimeter starting at an offset distance from the trunnions and extending along the left and right sides to a front-side and along the front-side of the receptacle body.

12. A trash receptacle consisting essentially of:

a. a receptacle body comprising:

i. an interior for receiving a flexible liner;

ii. an exterior;

iii. an opening having an opening perimeter;

iv. a hinge configured along the back-side of the receptacle body;

v. a liner retainer portion comprising;

a flange that extends around said opening perimeter to form a channel for receiving and retaining a flexible liner perimeter therein;

a flange extension extending downward from said flange and having a flange extension length, wherein said flange extension is configured at an offset distance from said hinge;

b. a lid comprising:

i. a hinge coupler, to retain the lid to the hinge;

wherein the receptacle body is configured to received and retain a flexible liner with the flexible liner perimeter retained in said channel;

whereby the flexible liner can be replaced with a new flexible liner without detaching the lid from said hinge;

wherein the liner retainer portion is an integral liner retainer portion with the receptacle body, wherein the receptacle body and liner retainer portion are a one-piece unit.

13. The receptacle of claim 12, wherein the hinge extends substantially all the way across the back-side of the receptacle body.

14. The receptacle of claim 13, wherein the liner retainer portion extends from an offset distance from the hinge, along the left and right sides to a front side and along said front of the receptacle body.

15. The trash receptacle of claim 12, wherein the liner retainer portion is an integral liner retainer portion with the receptacle body, wherein the receptacle body and liner retainer portion are a one-piece unit.

16. The trash receptacle of claim 15, wherein the flange extends completely around the receptacle perimeter and extends out from the opening perimeter and down a flange length to an extended end to form the channel.

17. The trash receptacle of claim 16, wherein the flange extension length is at least 0.75 the flange length.

* * * * *